US005975135A

United States Patent [19]

Aguirre-Esponda et al.

[11] Patent Number: 5,975,135

[45] Date of Patent: Nov. 2, 1999

[54] VALVE STRUCTURE FOR DOMESTIC RANGE BURNERS

[75] Inventors: Guillermo Aguirre-Esponda, Col. Bosques de la Florida; Rey-Eladio Mejia-Favela, Col. Arboleda de Tequis; Jose Trejo-Campos, Juventino Rosas; Jose-Sebastian González-Rodriguez, Celaya; Roberto González-Soto, Col. Residencial Tejeda, all of Mexico

[73] Assignees: Vitromatic Comercial, S.A. De C.V., Monterrey; Acrotec, S.A. De C.V., Guanajuato, both of Mexico

[21] Appl. No.: 08/988,749

[22] Filed: Dec. 11, 1997

[51] Int. Cl.[6] ..... F16K 5/10

[52] U.S. Cl. ..... 137/599.2; 251/310

[58] Field of Search ..... 137/599.2; 251/310

[56] References Cited

U.S. PATENT DOCUMENTS 2,583,959 1/1952 Mueller ..... 137/599.2

2,652,225 9/1953 Peterson et al. ..... 137/599.2 X 2,912,881 11/1959 Imhoff ..... 137/599.2 X 3,292,660 12/1966 Zarybnicky ..... 137/599.2

*Primary Examiner*—Stephen M. Hepperle

*Attorney, Agent, or Firm*—Abelman, Frayne & Schwab

[57] ABSTRACT

A linear turn down valve structure is disclosed, for gaseous fuels. The valve structure can advantageously be produced with aluminum alloys of die-casting grade, by means of a squeeze die-casting process. The valve structure comprises a valve body and a cap having register members to provide a self positioning and assembly of the main components of the valve. This eliminates the possibility of radial and axial misalignment thereof and secures a gas tight connection; a valve plug having passages in cooperation with a cap cam having three steps, to allow the safe switching of the continuous gas flow from maximum to minimum flow positions, as well as a safe turn-off position in a single operation; and a minimum flow control device to allow flow metering in order to permit the burners to operate with a wide variety of commercial gaseous fuels.

11 Claims, 5 Drawing Sheets

VALVE STRUCTURE FOR DOMESTIC RANGE BURNERS

BACKGROUND OF THE INVENTION

1. Field of the Invention

This invention is related to a valve structure for controlling domestic range burners and, more particularly, to a valve structure which may be manufactured preferably of aluminum alloys by the process of injection squeeze die-casting.

2. Description of the Related Art

There are a great number of valve structures which are known for controlling domestic range burners which are traditionally manufactured of copper or brass.

Also, there are a great number of valve components that improve the performance of such valves by providing diverse degrees of flame and including security devices.

Nevertheless, because of the cost of the traditional materials and number of independent pieces that are manufactured in numerous stages, it is desirable to simplify the structure of the valve, in order to reduce the number of pieces which have to be independently machined and assembled, as well as to impart to them characteristics of performance and functionality, utilizing lighter materials that allow them to produce them by means of injection squeeze die-casting processes.

The valve structure of the present invention, comprises a plurality of components which, because of their design and assembling, allow the components to be produced with aluminum alloys of die-casting grade. This permits the combined benefits of the squeeze die-casting process, such as allowing the use of commercial aluminum alloys of die-casting grade in order to obtain high performance mechanical and tribological properties by refining the grain size with a final forge which secures the porosity control. This results in the production of a minimum of post-manufacturing machining operations because of their low rugosity surface finishing. This is achieved with a surface finishing process for the valve workpiece, carried out by fluid-bed burring turbo abrasion, which imparts a surface hardness that improves its wearing strength and reduces its friction coefficient.

SUMMARY OF THE INVENTION

It is therefor a main object of the present invention, to provide a valve structure for controlling the gas flow in domestic range burners, which preferably allows manufacture utilizing aluminum alloys with the squeeze injection die casting process.

It is also a main object of the present invention, to provide a valve structure for controlling the gas flow in domestic range burners, of the above disclosed nature, which include integral formed elements to allow a reduction in the number and the machining operations of the components.

It is also a main object of the present invention, to provide a valve structure for controlling the gas flow in domestic range burners, of the above disclosed nature, which includes the register of elements in order to permit a self positioning and assembly of the main components of the valve, thereby eliminating the possibility of radial and axial misalignment of the components, resulting in a gas secure tightening.

It is still a main object of the present invention, to provide a valve structure for controlling the gas flow in domestic range burners, of the above disclosed nature, which includes components that allow switching of the minimum flame and maximum flame positions and turn-off position in a single counterclockwise operation.

It is a further object of the present invention, to provide a valve structure for controlling the gas flow in domestic range burners, of the above disclosed nature, which includes a minimum flow control device, allowing the burners to operate in an wide range of fuel gases.

These and other objects and advantages of the present invention will be apparent to those persons having ordinary skill in the art, from the following detailed description of the embodiments of the invention, illustrated in the accompanying drawings.

DETAILED DESCRIPTION OF THE INVENTION

Figure 1A:
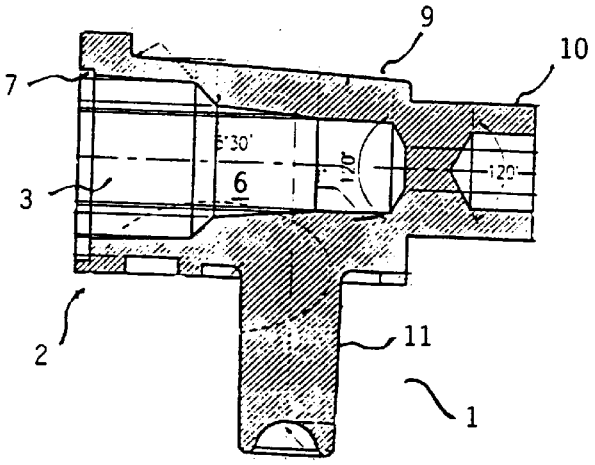
FIGS. 1*a,* 1*b,* 1*c,* and 1*d,* respectively are a lateral cross section view, a frontal elevation view, a rear elevation view, and a lower plan of a first embodiment of the valve body for the valve structure for controlling the gas flow in domestic range burners of the present invention.
Figure 1B:
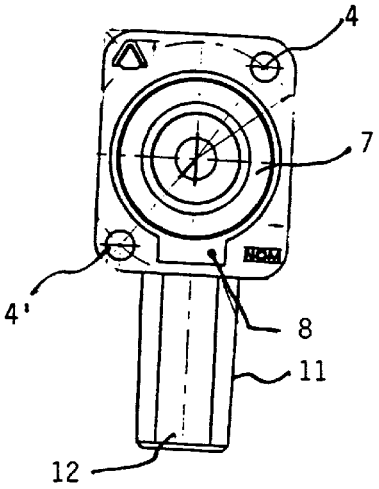
Figure 1C:
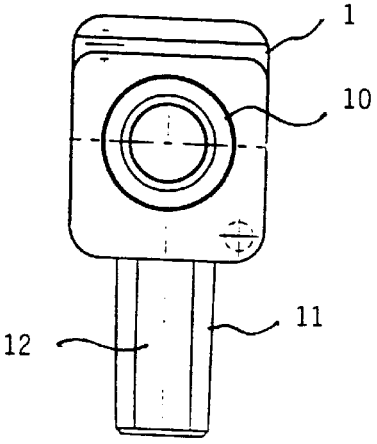
Figure 1D:
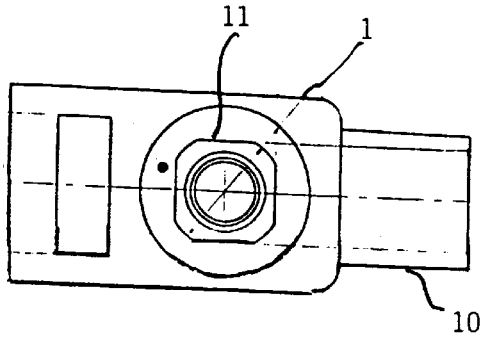

The following is a detailed description of the embodiments of the valve structure for controlling the gas flow in domestic range burners in accordance with the present invention, taking in relation with the accompanying drawings, wherein the same designations represent the same parts in the several drawings.

Figure 2A:
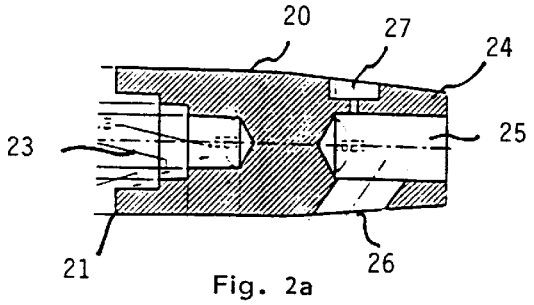
FIGS. 2*a,* 2*b* and 2*c,* respectively are a lateral cross section view, a lateral view and a top plan view of the first embodiment of the valve plug for the valve structure in accordance with FIGS. 1*a,* 1*b,* 1*c* and 1*d;*
Figure 2B:
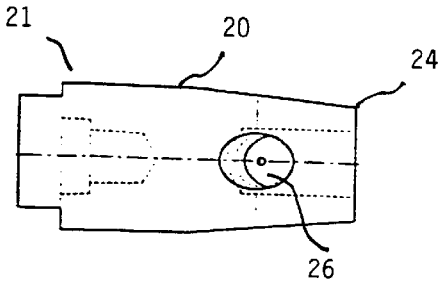
Figure 2C:
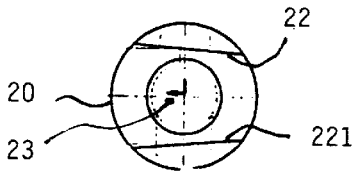
Figure 4A:
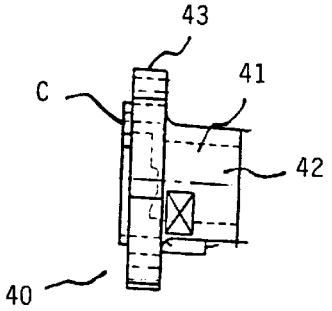
FIGS. 4*a,* 4*b;* 4*c* and 4*d,* respectively are an upper plan view, a lateral view, a lateral cross section view, a lower plan view, and a top plan view of the cap for the valve structure for controlling the gas flow in domestic range burners.
Figure 4B:
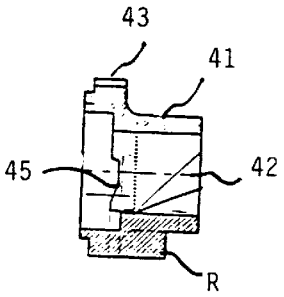
Figure 4C:
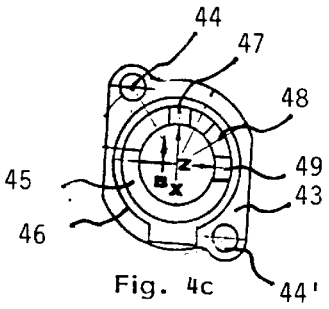
Figure 4D:
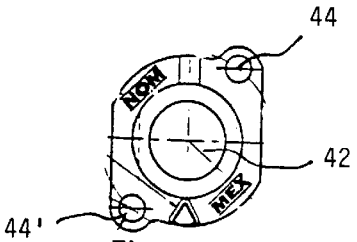
Figure 3A:
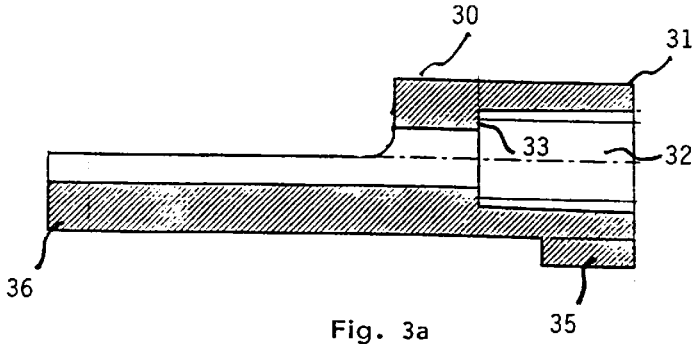
FIGS. 3*a,* 3*b,* 3*c* and 3*d,* respectively are a longitudinal cross section view, a front plan view, a longitudinal view and a rear plan view of the stem for the valve structure of the present invention.
Figure 3B:
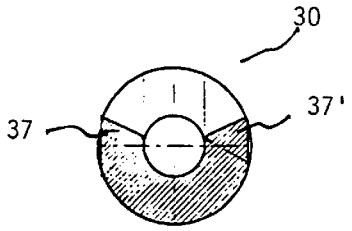
Figure 3C:
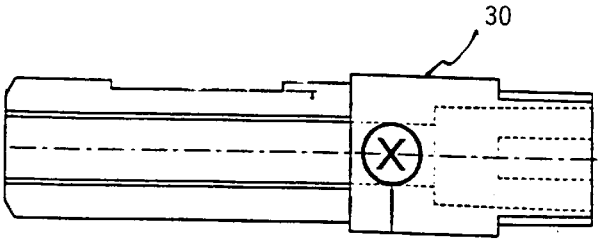
Figure 3D:
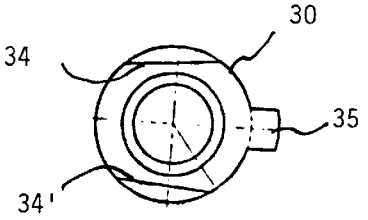
Figure 5A:
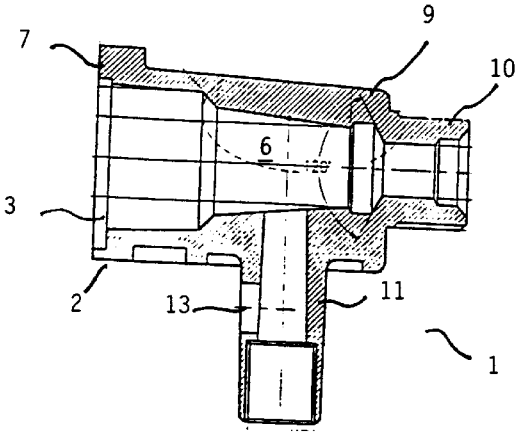
FIGS. 5*a* and 5*b,* respectively are a lateral cross section view, and a frontal elevation view, of a second embodiment of the valve body for the valve structure for controlling the gas flow in domestic range burners of the present invention.
Figure 5B:
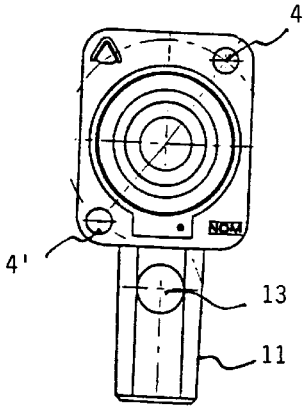
Figure 6A:
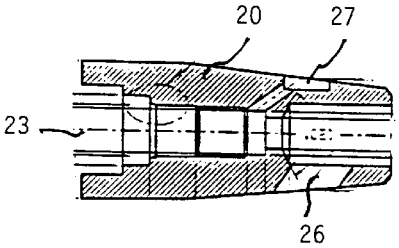
FIGS. 6*a,* 6*b* and 6*c,* respectively are a lateral cross section view, a lateral view, and a top plan view of a second embodiment of the valve plug for the valve structure in accordance with FIGS. 5*a,* and 5*b*.
Figure 6B:
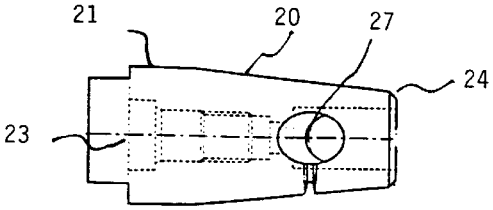
Figure 6C:
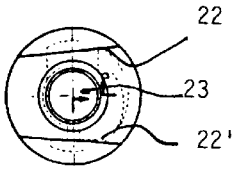

Referring to FIGS. 1 to 9 of the drawings, the valve structure for controlling the gas flow in domestic range burners, is preferably manufactured of aluminum alloys, by the squeeze injection die casting process. It comprises: a) a valve body 1 illustrated in the embodiment of FIGS. 1*a* to 1*d,* in the form of a rectangular block. A first end 2 of the rectangular block has a flat surface 3 including perforations 4, 4' in order to receive screws, a central conical housing 6, longitudinally passing through the body 1, a female annular shoulder 7, and a referential straight notch 8. A second end 9 has an integral outlet nipple 10 which is in fluid communication with the conical housing 6, and an external or internal screw thread in order to be coupled to a gas providing component (not illustrated) leading to the burners. A tubular inlet member 11 has a practically square cross section, and is perpendicular to one of the lateral faces of the body 1. Inlet member 11 has an internal passage 12 in fluid communication with the conical housing 6, to be threaded to a manifold (not illustrated) in order to provide gas to the valve, through a perforation 13 transverse to the tubular member 11;

b) a conical valve plug 20 illustrated in the embodiment in FIGS. 2*a,* 2*b* and 2*c,* which is coupled to the conical housing 6 of the valve body 1. It has i) a base end 21 having a cross cut 22, 22' in a "V" shape, having a wide end and a narrow end, to form a dovetail (FIG. 2*c*), (ii) a central internal housing 23; (iii) a flattened tip end 24, having a longitudinal central passage 25, which is in fluid communication with the nipple 11 of the body 1; iv) a first perpendicular passage 26 at the valve plug 20 and near to the tip end 24, which can be placed in fluid communication with the passage 12 of the tubular member 11, by rotating the plug valve in order to allow the feeding of the gas at its maximum flow capacity; and v) a second perpendicular passage 27 at the valve plug 20 and also next to the tip end 24, which can also be placed in fluid communication with the passage 12 of the tubular member, in order to permit the feeding of the gas at a minimum flow capacity; so that the coupling of the valve plug 20 into the conical housing of the valve body 1, allows diverse switching positions for the passage of the gas when the valve plug 20 is rotated by a knob;

c) a tubular stem 30, illustrated in FIGS. 3*a* to 3*d,* which can be rotationally operated by means of a knob (not illustrated), having i) a first end 31 which includes a longitudinal central passage 32, having an internal annular step 33, a longitudinal cut 34, 34' in order to present a dovetail coupling with the cross cut 22, 22' of the valve plug 20, and a longitudinal integral wing 35 as a positioning member, and ii) a second end 36, which is longitudinally cut-off as a half round, having an additional angular section 37, 37' at each side of the cut, in order to grip a knob;

d) a cap 40 illustrated in FIGS. 4*a* to 4*d* constituted by i) a tubular central member 41 to be coupled to the flat surface 3 of the body 1, ii) an internal passage 42 trough which passes the stem 30, and a flange portion 43 having perforations 44, 44' through which the screws are threaded to the perforations 4, 4' of the body 1, and iii) a male annular collar C to be coupled to the annular shoulder 7 of the body 1, in order to tightly couple the cap 40 to the body 1, and having an internal face 45 having a central annular cam 46, including a first step 47 corresponding to a turn-off position, which retain the wing 24 of the stem 30 to impede rotation of the stem 30, unless it is pressed and rotated counterclockwise; a second step 48 corresponding to the maximum gas flow capacity, so that upon pressing and rotating the stem 30 counterclockwise, the valve plug 20 rotates into the conical housing 6 of the body 1, communicating the passage 26 of the valve plug 20 with the passage 12 of the member 11 of the body 1; and a third step 49 corresponding to the minimum gas flow capacity position, so that upon pressing and rotating the stem 30 counterclockwise, the valve plug 30 rotates into the conical housing 6 of the body 1, communicating the passage 27 of the valve plug 20, with the passage 12 of the body 1, in order to allow the gas passage at its minimum flow capacity. This affords a controlled passage of gas in accordance with the position of the valve plug 30, by pressing and rotating the stem 30 by a knob, and the turning off of the gas passage by a single rotation clockwise of the stem 30; and e) a spring 50 placed within the housing 23 at the base end 21 of the valve plug 20, with the passage 32 of the stem 30 resting against the annular step 33 of the stem 30, in order to push the stem 30 against the cap 40. This allows a slight pressure and rotation clockwise of the stem 30 by means of the knob, to place the wing nut 24 at the second or third steps of the annular cam 46 and, by a single rotation counterclockwise, place the wing nut 24 of the stem 30 in the first step 46 of the annular cam 45, thereby turning-off the gas passage.

Figure 7:
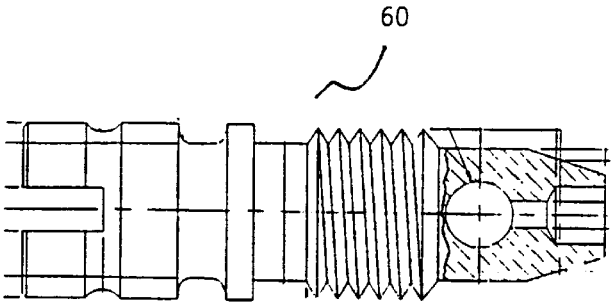
FIG. 7 is an longitudinal elevation view of a single embodiment of a minimum flow control device for the valve plug illustrated in FIGS. 6*a,* 6*b* and 6*c;*
Figure 8:
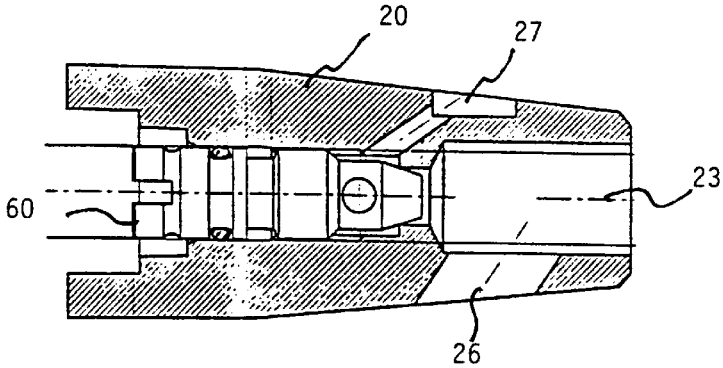
FIG. 8 is a longitudinal cross section of the valve plug of FIGS. 6*a,* 6*b* and 6*c,* including the minimum flow control device of FIG. 7, duly assembled.
Figure 9:
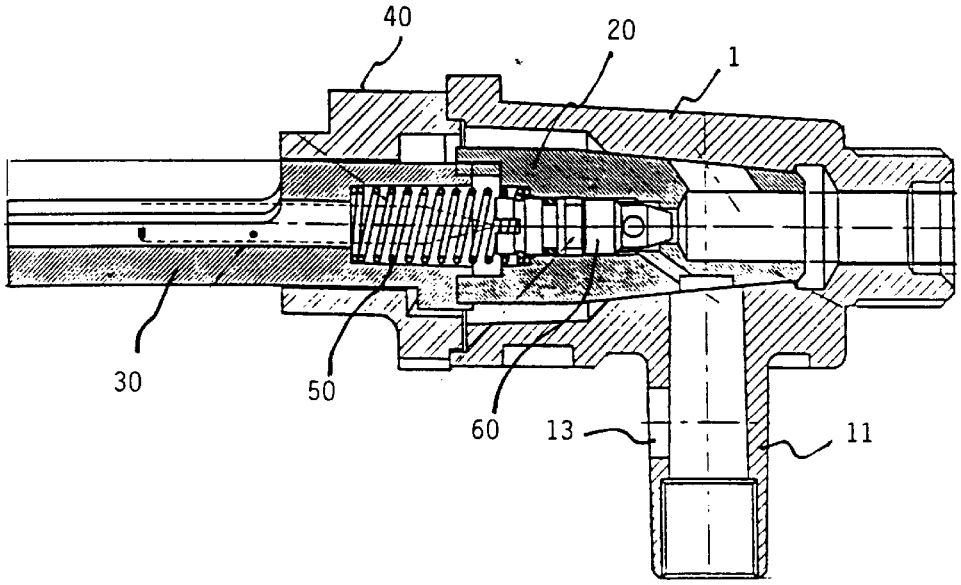
FIG. 9 is a lateral cross section view of an embodiment of the valve structure for controlling the gas flow in domestic range burners, showing the whole components duly assembled.

The housing 23 of the conical valve plug 20, can pass longitudinally throughout the plug 20, and can include an internal thread 28 to receive the minimum flow control device 60, as illustrated in FIG. 7, in order to graduate its penetration into the housing 23 of the valve plug 20 which is coupled in the conical housing of the body 1.

The tubular stem 30, is preferably hollow to allow the access of a screw driver or similar tool, in order to adjust the penetration of the minimum flow control device 60 and regulate the gas capacity. It is clipped as a half round starting from the second third of their length, in order to allow the self adjusting assembly of the knob. In this case, the spring 50 is placed between the passage 32, abutting against its annular step 33 of the stem 30, and the housing 23 of the plug 20, resting on the minimum flow control device 60.

The cap 40 may include an integral rib R, in order to allow the gripping an alignment of an electronic turn-on sensor element (not shown).

This design of the valve body 1 allows its mounting on a feeding pipe using an integral pivot whose function is to align the valve with the distributing tube and permit the gas passage into the valve. Furthermore, the entire design of the valve assures its gas tightness.

The design of the body includes the straight notch 8 at the body 1 as a register element with the cap 40 in order to permit a self orientation and assembly of the cap 40 with the body 1.

Advantageously, the nipple 10 of the body 1 can be coupled to the gas circuit which leads the gas to the burners.

This valve has, among others, the following advantages:

The novel self positioning coupling of the valve body with the cap and the stem with the valve plug, eliminates the possibility of radial and axial misalignment of these components thereby securing a gas tight connection.

The integral wing of the stem, in combination with the cam of the integral cap, allows the safe switching between the maximum flame and minimum flame positions, as well as a safe turn-off position in a single clockwise operation.

The square cross section of the tubular member of the valve body, allows it to be self-aligned with the gas feeding manifold, so that the flatness and perpendicularly of this member, secures a gas tight connection.

The longitudinal cut of the stem as a half round, having an additional angular section at each side of the cut, in order to grip the knob, provides for self-aligning and positioning thereby avoiding loosening thereof.

The integral rib at the cap allows it to grip and align an electronic turn-on sensor element.

As a further advantage, the minimum flow control device, allows the burners to operate with a wide range of fuel gases.

It will be further considered that the above detailed description of the valve structure for controlling the gas flow in domestic range burners are only representative embodiments of the valve structure of the present invention, which are not to be considered as a limitation of the invention which will be described in the following claims.

What is claimed is:

1. A valve structure for controlling the gas flow in domestic range burners, to be manufactured preferably of aluminum alloys, by the process of squeeze injection die casting, comprising:

a) a valve body in form of a rectangular block having a first flat end surface including gripping means and self positioning means to be self-orientated coupled to a cap, a central longitudinal conical housing, and a second end having an integral outlet nipple in fluid communication with the conical housing, to be coupled to gas tubing means leading the gas to the burners, and a tubular square cross section inlet member, perpendicular to a lateral face of the body, having an internal passage in fluid communication with the conical housing, to be coupled to a gas feeding manifold;

b) a conical valve plug rotary coupled to the conical housing of the valve body, and having: a base end having a cross cut in "V" shape, as a dovetail coupling, a central internal housing, a flattened tip end including a longitudinal central passage in fluid communication with the nipple of the valve body, a first perpendicular passage at the valve plug and near to the tip end, to be placed in fluid communication with the passage of the tubular member of the body, by rotating the plug valve in order to allow feeding gas at its maximum flow capacity, and a second perpendicular passage at the valve plug and also next to the tip end, to be placed in fluid communication with the passage of the tubular member, by rotating the plug valve in order to permit feeding gas to a minimum flow capacity;

c) a tubular stem having a first end including a longitudinal central passage, two longitudinal cuts, one at each side of the stem, in order to present a dovetail coupling with the valve plug, and a longitudinal integral positioning member, and a second end which is longitudinally cut-off as a half round, in order to grip a knob;

d) a cap including a tubular central member to be coupled to the flat surface of the body, trough which passes the stem, and a flange portion having gripping means to be gas tightening coupled to the body, and an internal face having a central annular cam, including a first step corresponding to a turn-off position, retaining the integral positioning member of the stem impeding rotation thereof, unless this is pressed and rotated, a second step corresponding to an ignition position, so that by pressing and rotating the stem, the valve plug is rotated into the conical housing of the body, communicating the first passage of the valve plug with the passage of the tubular member of the body, and a third step corresponding to a maximum gas capacity position, so that by pressing and rotating the stem, the valve plug rotates into the conical housing of the body, communicating the second passage of the valve plug, with the passage of the body, in order to allow the passage of the gas at its maximum capacity, affording in this way a controlled passage of gas in accordance with the position of the valve plug, by pressing and rotating the stem, and turn-off the gas passage by a single rotation of the stem; and e) a spring placed within the housing of the valve plug and the passage of the stem, in order to push the stem against the cap, and allow that, by pushing and rotating the stem, the positioning member be placed at the second or third steps of the annular cam and, by a single rotation, place the positioning member of the stem in the first step of the annular cam, turning-off the gas passage.

2. The valve structure according to claim 1, wherein the gripping means of the valve body comprising screw perforations to receive screws, and the self positioning means of the first flat end of the body including a female annular shoulder and a referential straight notch.

3. The valve structure according to claim 1, wherein the central conical housing of the valve body, longitudinally pass throughout the body.

4. The valve structure according to claim 1, wherein the central internal housing of the conical valve plug longitudinally extends throughout the plug and includes an internal thread to receive a minimum flow control device, in order to graduate its penetration into the housing of the valve plug which is coupled in the conical housing of the valve body.

5. The valve structure according to claim 1, wherein said longitudinal central passage of said tubular stem, includes an internal annular step to retain said spring, and said longitudinal integral positioning member includes a longitudinal integral wing.

6. The valve structure according to claim 1, wherein the gripping means of the cap includes perforations through which screws are threaded to the perforations of the body.

7. The valve structure according to claim 1, wherein the spring placed within the housing of the base end of the valve plug and the passage of the stem, abuts against the annular step of the stem, in order to push the stem against the cap and allow that, by pressing and rotating clockwise of the stem by means of a knob, the wing is placed at the second or third steps of the annular cam of the cap and, by a single rotation counterclockwise, place and retain the wing of the stem in the first step of the annular cam of the cap, turning-off the gas passage.

8. The valve structure according to claim 1, wherein the cap includes an integral rib, in order to allow to grip and align an electronic turn-on sensor element.

9. The valve structure according to claim 1, wherein the tubular stem is hollow to allow the access of a screw driver or similar tool, to adjust the penetration of the minimum flow control device and regulate the gas capacity, and it is clipped as a halve round starting from the second third of their length, to allow the self adjusting assembly of a knob.

10. The valve structure according to claim 1, wherein the longitudinally cut-off as a half round, of the second end of the stem, having an additional angular section at each side of the cut, in order to securely grip a knob.

11. The valve structure according to claim 1, wherein the stem coupled to the valve plug, is to be pushed and rotated counterclockwise to place the valve plug at its maximum and minimum gas flow capacity, and clockwise to place the valve plug in its turn-off held position.

* * * * *